United States Patent [19]

Elberg

[11] 4,100,032

[45] Jul. 11, 1978

[54] PROCESS FOR CARBONIZING LIGNITE COAL

[75] Inventor: Anton J. Elberg, Dickinson, N. Dak.

[73] Assignee: Husky Industries Inc., Dickinson, N. Dak.

[21] Appl. No.: 818,522

[22] Filed: Jul. 25, 1977

[51] Int. Cl.[2] ..... C10B 49/00; C10B 53/00; C10B 57/02

[52] U.S. Cl. ..... 201/27; 44/1 F; 44/10 C; 201/32; 201/37; 201/44

[58] Field of Search ..... 201/8, 24, 27, 32, 34, 201/37, 44; 202/117, 120; 44/1 F, 10 C, 10 D, 10 G, 1 G

[56] References Cited

U.S. PATENT DOCUMENTS

| | | | |
|---|---|---|---|
| 1,334,170 | 3/1920 | Runge | 201/24 X |
| 3,062,629 | 11/1962 | Margolin et al. | 44/15 R |
| 3,379,622 | 4/1968 | von Dreusche, Jr. | 201/8 |
| 3,668,077 | 6/1972 | Ban | 201/44 X |
| 3,671,402 | 6/1972 | Wenzel et al. | 201/27 X |
| 3,980,447 | 9/1976 | Franke et al. | 201/6 X |
| 4,050,389 | 9/1977 | von Dreusche, Jr. | 202/117 X |

FOREIGN PATENT DOCUMENTS

| | | | |
|---|---|---|---|
| 213,040 | 3/1924 | United Kingdom | 201/24 |

*Primary Examiner*—Joseph Scovronek
*Attorney, Agent, or Firm*—N. E. Von Behren

[57] ABSTRACT

A process for carbonizing lignite coal in a Herreshoff Carbonizer of a multi-hearth type. The novel process comprises the steps of introducing given quantities of lignite in the first and succeeding hearths while introducing sufficient quantities of combustion air and fuel to ignite the fuel and to raise the temperature of the hearths until the process is self-sustaining as a result of the combustion of the volatiles driven off of the lignite. The hearth temperatures range approximately 1450° to 1620° F in the first furnace hearth with the second furnace hearth ranging approximately 1650° to 1800° F and the third furnace hearth ranging approximately 1650° to 1890° F. Sufficient combustion air is introduced into various hearths of the furnace to insure complete combustion in at least the first hearth and in the stack of the volatiles being driven off thereby making the process self-sustaining, allowing the introductory fuel to be cut off. The final volatile content of the specification char made in the furnace from the lignite is controlled by utilizing the remaining succeeding hearths in the furnace with the temperatures ranging in these hearths approximately 900° F to 1250° F. The specification char thereby made in the furnace is a char manufactured to a definite residual volatile content.

10 Claims, 2 Drawing Figures

PROCESS FOR CARBONIZING LIGNITE COAL

BACKGROUND OF THE INVENTION

This invention relates to the formation of specification char from lignite in general and more particularly to a new and improved process for utilizing an existing furnace of the Herreshoff type or the like to produce specification char.

It is known in prior art types of furnace construction to be able to produce charcoal from materials that were formerly wasted or burned such as bark, shavings, chips, slabs, trim and sawdust and also from agricultural wastes such as nutshells, hulls, fruit pits and bagasse in a Herreshoff Carbonizer Furnace. This type of furnace is capable of carbonizing these materials thoroughly and uniformly despite their high insulating properties and small particle sizes, because the furnace stirs the materials continuously in thin layers over a large flat surface area moving the materials from one hearth to an adjacent hearth until the material has been carbonized to the desired degree.

Furnances of the Herreshoff type generally utilized temperatures in the first or drying hearth ranging from 800° to 1400° Fahrenheit with temperatures in the last hearth ranging from 1000° to 1400° Fahrenheit averaging approximately 1200° F. Furnaces of this type are shown in the U.S. Pat. No. 3,379,622 issued Apr. 23, 1968, to C. F. Von Dreusche, Jr. While satisfactory for producing char from wood and particles similar thereto generally weighing in the range of 18 to 20 lbs./cubic foot, these furnaces were not satisfactory for manufacturing lignite char weighing approximately 40 lbs./cubic foot and having a much higher volatile content. When attempting to use the Herreshoff furnace with lignite, it was found that by utilizing the normal temperatures, as for example in the first hearth of 800° to 1400° F, the volatile products that were driven off were very large in volume and comprised a mixture of heavy and light hydro-carbons which were difficult to handle and condensed in the production system where it was undesirable. As a result of this condensation, the explosion potential of this gassy condition, the potential for agglomeration of the lignite, and the odor given off by the hydro-carbons, it was felt that the Herreshoff furnace was undesirable for the manufacture of lignite char when operated according to established multi-hearth procedures well known to the art.

Other types of furnaces have been used for the manufacture of charcoal such as the Lurgi furnace which has been in existence since the early 1900's and was used by the Germans to extract hydro-carbons for the manufacture of gasoline and kerosene during the second World War. The Lurgi process is a "low temperature" process and takes the off gases and scrubs them whereupon they are condensed and the tars and pitches in the gases are extracted and the gases are used for other purposes. Problems were also encountered in using the Lurgi type furnaces since a certain percentage of the light hydro-carbons are emitted during production of the char along with the thirty-five percent moisture that first comes off of the lignite resulting in obnoxious odors emitting into the surrounding neighborhoods. The lower temperatures at which the furnaces operate are not sufficient to burn off the hydro-carbons allowing them to go off in the form of steam and light volatiles that produce the unpleasant odor. From experimentation, it was finally determined that the problem in using the prior art type furnaces resulted from the fact that lignite being a lesser form of coal and containing approximately thirty-five percent water, was a much more complex material to carbonize in the furnace since the volatile content of lignite was much more complex compared to the wood previously carbonized in the furnaces. In addition, the lignite molecules were much larger than wood resulting in their hydro-carbons being much bigger and heavier meaning that if they were carbonized at the lower temperatures utilized in the prior art furnaces, a greater pollution problem would occur plus explosion problems which were potentially available unless the various exhaust systems were kept clean. These problems resulted from the fact that the hydro-carbons of lignite were found to condense out in the various parts of the system where it was highly undesirable for the condensation to occur.

It is known in the art of carbonizing lignite and other materials to manufacture briquettes which are used in a metallurgical process where high compressive strength is required that the process is one in which the coal tar pitch volatiles are retained and/or recovered and become an important part of the binding process directly in the formulation of the briquette. Briquettes of this type are different from the briquette that the applicant is attempting to manufacture with the applicant's briquette being utilized for sale to a home consumer to be used for backyard cooking where high compressive strength is not required in the briquette. Such prior art briquettes manufactured for metallurgical processes are typified in the following U.S. patents:

| Pat. No. | Issue Date | Inventor |
|---|---|---|
| 1,443,359 | January 30, 1923 | C. I. Gillstrap |
| 3,671,402 | June 20, 1972 | W. Wenzell et al |
| 3,758,385 | September 11, 1973 | K. O. P. Fischer |
| 3,980,447 | September 14, 1976 | F. Franke et al |
| 3,026,252 | March 20, 1962 | W. Muschenborn et al |
| 3,414,480 | December 3, 1968 | H. H. Stotler et al |
| 3,051,629 | August 28, 1962 | E. Gorin et al |
| 3,140,241 | July 7, 1964 | J. Work et al |
| 3,184,293 | May 18, 1965 | J. Work et al |
| 3,316,155 | April 25, 1967 | M. O. Holowaty et al |
| 4,002,534 | January 11, 1977 | R. Rammler et al |

In the carbonization of lignite it is known to produce charcoal briquettes which are clean burning and are suitable for use in cooking of food over an open fire. The processes for manufacturing these lignite barbeque briquettes are typified in the following two patents:

| Pat. No. | Issue Date | Inventor |
|---|---|---|
| 3,026,189 | March 20,1962 | A. B. Hall |
| 3,062,629 | November 6, 1962 | S. V. Margolin et al |

It is noted that in the Hall process (3,026,189) there is utilized a rotary kiln which is fired internally with natural gas and an air mixture which provides for substantial de-volatilization at temperatures ranging from 1150° to 1450° with a retention time of 45 to 48 minutes. Such a process by its very nature does not provide for any meaningful control of the degree of de-volatilization of the lignite as does the applicant's invention as will be described more fully hereinafter and in addition the Hall process is not self-sustaining since the rotary kiln requires natural gas as a fuel in order to carbonize the lignite.

The Margolin process (3,062,629) deals with the beforementioned Lurgi process and furnace of which there are only two in the United States both of them being owned by the assignee of the subject invention. The Margolin process is a low temperature process operating in the range of 500° to 550° C or 932° to 1022° F.

SUMMARY OF THE INVENTION

In order to overcome the problems inherent in the prior art processes beforementioned there has been provided by the subject invention a new and novel process for carbonizing lignite which may be used in a Herreshoff type of furnace and other types and which comprises the steps of introducing given quantities of lignite in the first and succeeding hearths of the furnace while introducing sufficient quantities of combustion air and fuel to ignite the fuel and to raise the temperatures of the furnace hearths. Thereafter the temperatures in the first hearth are raised in the range of approximately 1450° to 1620° F while raising the temperature in the second and third hearths in the range of approximately 1650° to 1800° F and 1650° to 1890° F respectively. By raising the hearths to the beforementioned temperatures, the moisture contained in the lignite is able to be driven off and in addition a major portion of the volatiles in the lignite are also driven off whereupon the volatiles are able to burn in the hearth making the process self-sustaining which allows the combustion fuel introduced previously to be shut off resulting in fuel savings. By continuing to supply sufficient quantities of combustion air to the furnace hearths to assure complete combustion of the lignite volatiles in at least the first hearth and in the stack and by controlling the temperatures in the first three hearths of the furnace, the lignite is then able to be passed to succeeding hearths temperatures in the range of approximately 900° to 1250° F whereby critical control of the degree of volatile removal of the lignite is obtained in order to produce the specification char for industry which is satisfactory for use in the manufacture of briquettes for cooking.

By controlling the rate of feed of raw material and the availability of complete combustion air in at least the first hearth and in the stack, and as a result of the temperature of each hearth level being raised to higher temperatures, the total production in tons of the process is able to be varied and the accuracy of the volatile content of the product discharged from the furnace is able to be controlled with a considerable degree of accuracy. By utilizing sufficient combustion air to have complete combustion, the combustion of all the off-gas material can be completed in the upper hearth of the furnace and the stacks or ducts exiting from the first hearth thereby eliminating many of the beforementioned problems encountered in the prior art type furnaces.

Accordingly it is an object and advantage of the invention to provide an improved process for the manufacture of lignite charcoal whereby the charcoal may be formed in a Herreshoff type furnace.

Another object and advantage of the invention is to provide a new and improved process whereby the temperatures of the respective hearths in the carbonizing furnaces are raised to predetermined amounts so that a major portion of the volatiles in the lignite are driven off and burned in the furnace thereby making the process a self-sustaining one resulting in fuel savings.

Yet another object and advantage of the invention is to provide a new and improved process for the manufacture of lignite char wherein the volatile content of the product discharged from the furnace may be controlled with a high degree of accuracy resulting in a more uniform specification char that is satisfactory to the ultimate user. These and other objects and advantages of the invention will become apparent from a study of the drawing and from a reading of the description of the preferred embodiment and the accompanying claims of the invention.

DESCRIPTION OF THE PREFERRED EMBODIMENT

Figure 1:
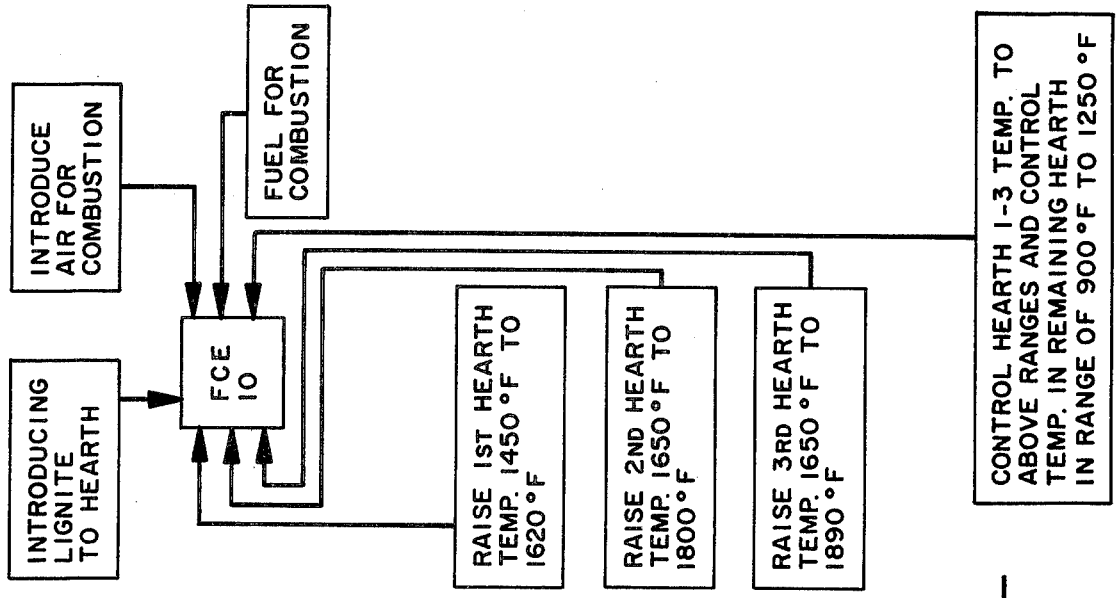
FIG. 1 is a diagrammatic of the applicant's new and novel process for the manufacture of specification char from lignite.
Figure 2:
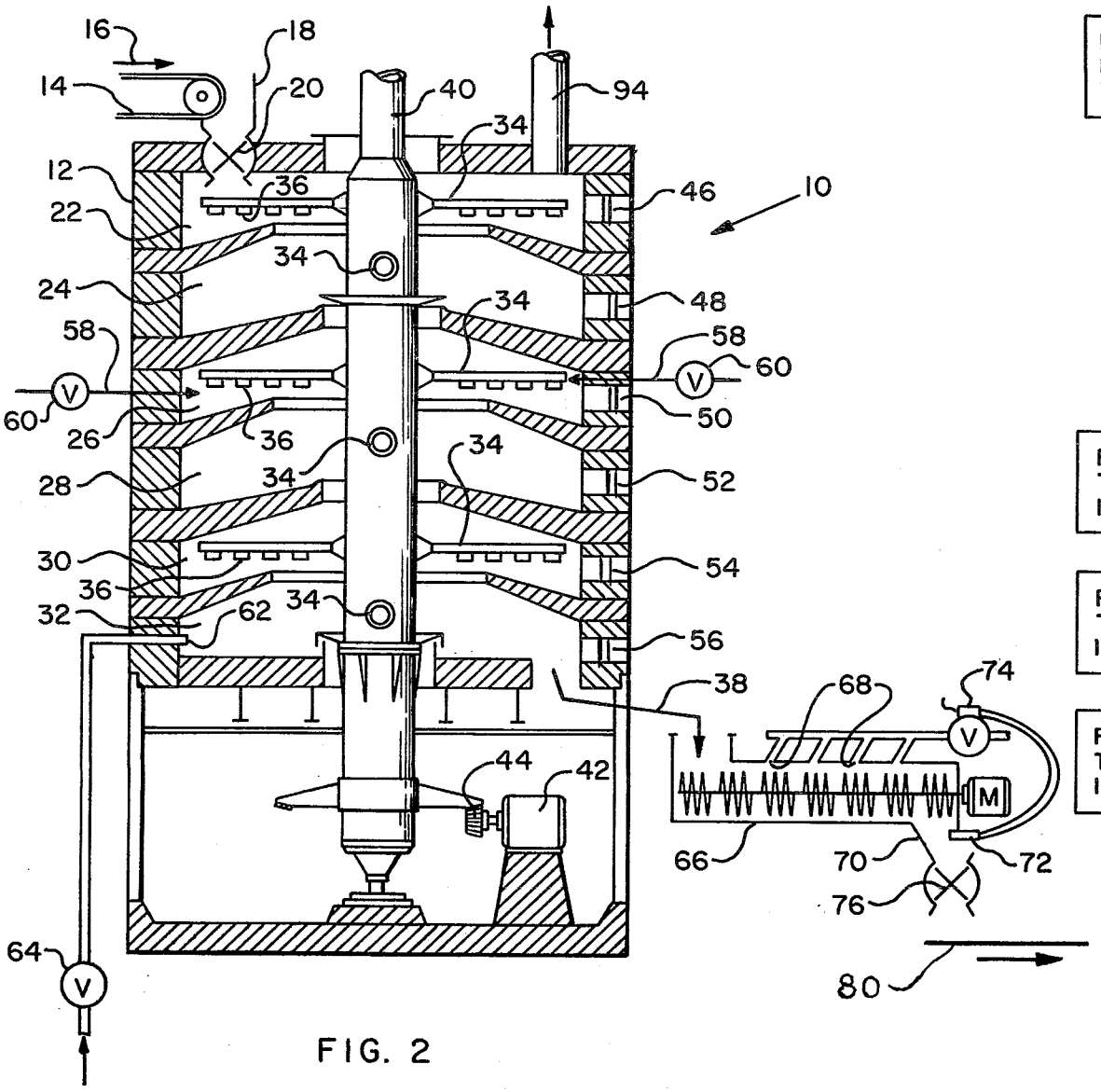
FIG. 2 is a schematic diagram showing a Herreshoff type furnace utilizing the applicant's process for the manufacture of specification char.

Referring now to the drawings in general and in particular to FIG. 1 of the drawing there is shown in diagrammatic form the applicant's new and novel process relating to a multiple-hearth furnace of the Herreshoff type. The process will be described more fully hereinafter after reference is made to FIG. 2 of the drawing which shows in detail the applicant's multiple-hearth furnace. The furnace, shown generally by the numeral 10, comprises an outer shell 12 having a suitable conveyor 14 discharging in the direction shown by the arrow 16 into the top of the furnace through a suitable inlet means 18 which will exclude entrance of the atmosphere to the furnace. The means for excluding the atmosphere may comprise a star-type feeder 20 as is well known in the art and may comprise other types of excluding means. In the preferred embodiment shown in FIG. 2, the furnace 10 is constructed with six circular superimposed hearths 22, 24, 26, 28, 30, and 32 constructed in accordance with well known furnace practice known in the Herreshoff furnace art. Each of the circular hearths is accompanied by rotating radially extending rabbling arms 34 having numerous depending teeth 36 thereon for rabbling the material on the hearths gradually inwardly and outwardly respectively on alternate hearths and through hearth openings down through the furnace to an outlet 38. The rabbling structure may be formed if desired with conventional cooling cavities, the rabbling arms being carried by a central shaft 40 rotated at variable speeds by a motor 42 connected to a gear 44.

Each hearth is constructed having an external door 46, 48, 50, 52, 54, and 56 which may be used for admitting combustion ambient air to the various hearths in the furnace in order to control the combustion of the lignite. In addition to the hearth doors, the third hearth 26 also has formed, at spaced points, preferably around the upper wall surface portions of the spaces above each hearth, a plurality of conduits 58 projecting into the area above the material being rabbled on the hearths. The conduits 58 are provided and spaced apart to introduce combustion air by means of the valves 60 from an air compressor or blower not shown in the drawings. It may also be desirable to locate conduits 58 and valves 60 in the first hearth 22 as well as the second hearth 24 and also in the fourth hearth 28, the fifth hearth 30, and the sixth hearth 32. From the above it can be seen that by utilizing the compressed air for combustion purposes into the third hearth 26 and where desired in the other hearths the combustion of the lignite can be critically and accurately controlled in the hearths also by utilizing the opening of the various hearths doors 46, 48, 50, 52, 54, and 56 either singly or in conjunction with the combustion air.

The conduits 58 and control valves 60 may be varied in number as is desired and the inner ends of these conduits may be located so as to be spaced somewhat away from the regions where the material falls into the furnace or falls through drop holes from one hearth to the next. The last hearth 32 also has one or more fuel burners 62 controlled by a valve 64 for burning a limited amount of extraneous fuel such as natural gas in this hearth space for the express purposes of starting up the process and heating up the various furnace hearths until it becomes unnecessary to provide such extraneous fuel after the process become self-sufficient whenever the volatiles are driven off of the lignite during full operation of the furnace.

At the furnace outlet 38, the charcoal material without being exposed to the atmosphere is preferably dropped into a paddle type conveyor 66, water cooled, to advance the charcoal while mixing with some water introduced through the spray nozzles 68. Such conveyor means is so designed as to advance the material through the conveyor in a relatively short period of time, for example, three to four minutes up to ten minutes during which time the charcoal is subjected to moisture throughout but because of the temperature present, the material does not remain moistened. The material is thus reduced in temperature to preferably somewhat above the boiling point of water, for example, about 220° to 300° F before being discharged from the conveyor outlet 70. The outlet as indicated may be provided with a thermocouple 72 or other temperature sensing device connecting either pneumatically, electrically or otherwise to valve controlling means 74 so controlled by the temperature sensing device as to regulate the amount of spray water at the spray nozzles 68 so that the temperature of the discharge material will be within a range such as beforementioned.

The charcoal as discharged from the conveyor outlet 70 will now have been reduced in temperature sufficiently so that it will not tend immediately to ignite on exposure to the atmosphere yet it will be further treated to prevent over-reactive or "hot spots" therein from later causing spontaneous combustion upon exposure to the air. The material leaving the conveyor outlet 70 passes through a rotary valve 76 to an auger 80 to be conveyed to storage.

The combustible volatiles and particulate matter driven off of the lignite that may not be burned in the self-sustaining process are removed from a stack 94 to pollution control equipment and thereafter are exhausted to the atmosphere. The pollution removal equipment may be of various types and forms no part of the subject invention and may be covered in a co-pending application by the applicant of the subject new and novel process.

Referring now specifically to FIG. 1 of the drawing there will be briefly described the improvement in the Herreshoff Furnace resulting in a new and novel process for producing specification char from lignite. In the process, the given quantities of lignite are first introduced into the first and succeeding hearths while introducing sufficient quantities of combustion air and fuel to raise the temperature of the furnace. The combustion fuel is introduced through the fuel burner 62, shown in FIG. 2, and the combustion air is introduced through the conduit 58 as well as the doors 46, 48, 50, 52, 54, and 56 as desired. Thereafter the temperature of the first hearth is controlled or raised to the approximate range of 1450° to 1620° F while admitting sufficient combustion air to the first hearth and to the remaining hearths to assure complete combustion of the volatiles at least within the first hearth and in the stack and to drive off a major portion of the moisture contained in the lignite while the lignite is in the first hearth.

By controlling the temperature in the second hearth in the range of approximately 1650° and 1800° F while admitting sufficient combustion air to the second hearth for combustion, the remainder of the moisture contained in the lignite is driven off and also a portion of the volatiles contained in the lignite being to be driven off. These volatiles then are utilized in the furnace as a combustion fuel making the process self-sustaining thereby permitting the previously introduced natural gas to be shut off.

The temperature in the third hearth is thereafter raised or controlled in the range of approximately 1650° and 1890° F while admitting sufficient combustion air to the third hearth and to drive off a major portion of the volatiles contained in the lignite with the volatiles driven off in the third hearth also being used as combustion fuel as beforementioned.

Thereafter the remaining hearths in the furnace if more than three hearths are utilized are temperature controlled in the range of approximately 900° to 1250° F to control and drive off a predetermined portion of the volatiles in the lignite so that the volatile content of the lignite is closely controlled resulting in a predetermined final specification char being produced in the multi-hearth furnace. In the furnace shown in the preferred embodiment, a total of six hearths are utilized with the temperature, for example in the fourth hearth, being controlled in the range of approximately 900° to 1140° F and the temperature in the last hearth being controlled approximately in the range of 910° to 1190° F.

When the process is controlled in this manner, the volatile content of the char produced in the furnace may range approximately between five and twelve percent and more specifically may range between 5.5 and 11.4 percent in test samples. In addition, it is felt that the volatile content may be controlled in the range of approximately between 1 and 20 percent depending upon the hearth temperatures.

In a typical example of the new and novel process which has been found to give very satisfactory results, the beforementioned volatile contents of the char produced being recorded at the time the sample was taken with the 5.5 percent volatile content being recorded at 12:00 noon and the 11.4 percent volatile content being recorded at 8:00 p.m. In addition at 4:00 a.m. in the following morning, a volatile content of 6.5 percent was recorded. This latter volatile content was recorded when the temperature in the first hearth was 1580° F, and the temperature in the second hearth was recorded at 1760° F. During this same time, the third hearth temperature was recorded at 1840° F and the remaining three hearths recorded temperatures respectively of 1250° F, 1130° F, and 1160° F. Stack temperatures at this time ranged between 1900° and 1930° F.

During this time, there was no introduction of natural gas into the furnace indicating that the process was self-sustaining with the volatile matter emitting from the lignite being utilized as combustion fuel. The only time natural gas was used was during the start-up procedures. During the example operating time periodic moisture balances on the feed stack to the furnace were conducted and recorded with the coal moisture being thirty-four percent at 12:00 p.m. and 33.4 percent at 8:00 p.m. During the trial period, the coal feed was monitored in pounds per hour as well as the char produced in pounds per hour and the coal feed setting was constant during the entire day with no down time resulting for the operation during a 24 hour period.

By charting the hearth temperatures against percent volatiles in the char and the coal input and char yield against percent volatiles of the char, it can be seen from the following charts representing these figures taken on a typical day that there is a direct correlation between the hearth temperatures and the percent volatile remaining in the char. A similar correlation can be drawn in the charting of input percent volatiles and it is felt that the volatile content of the char may range between approximately 1 and 20 percent depending upon the hearth temperatures.

Multi-Hearth Furnace No 1
Date 5/8/77

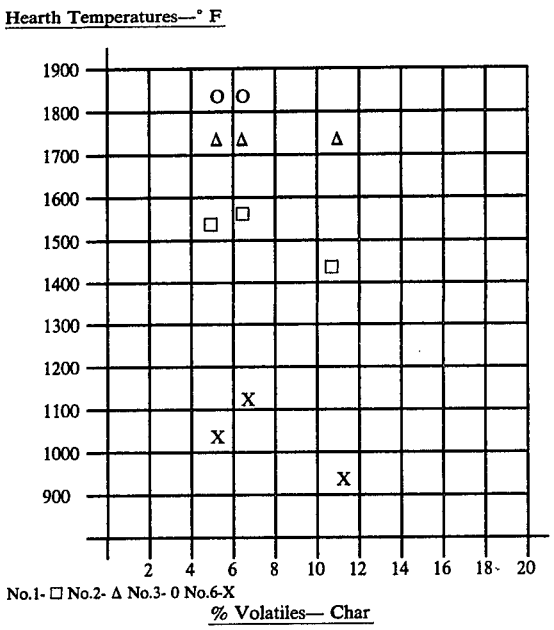

-continued

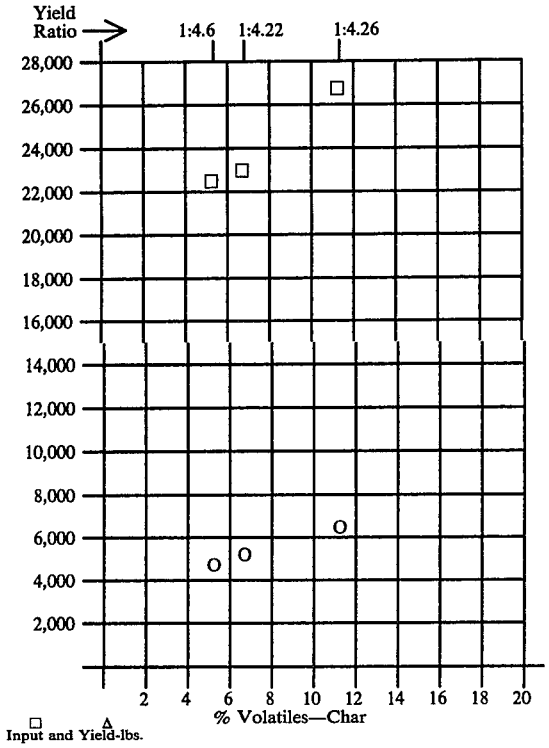

In the operation of the furnace to date, experimentation still continues and other factors which are not shown in the data would tend to indicate that the percent moisture in the lignite feed stacks may have a direct effect on the yield ratio so as to cause a reduction in the feed rate and an adverse effect on the yield ratio. It is felt that the percent moisture in the lignite feed stacks may run as high as forty or forty-one percent as a result of precipitation in the area and may have to be more critically controlled in order to minimize the adverse effect on the yield ratio. It is also felt that the particle size of the lignite feed stock will have some effect on the performance of the furnace, however, to date this information is not available and the particle size should have a considerable effect on the manner in which the furnace is operated in future testing.

In the preferred embodiment shown, the hearth temperatures on the six herths in the furnace varied throughout the twenty-four hour operating day as shown below with these temperatures also corresponding to the beforementioned statistics herein described during the typical operating day:

| TIME | TEMP. ON HEARTH #1 | #2 | #3 | #4 | #5 | #6 | Center Shaft | West Stack | East Stack | Char Temp | Water Temp | Char VCM | Manual Air Settings (HEARTH Burner) 3-1 | 3-2 | % Coal Moist | Char Moist | Coal # Feed/Hr. | Char. #/Hr. | Coal Feed Set |
|---|---|---|---|---|---|---|---|---|---|---|---|---|---|---|---|---|---|---|---|
| May 8, 1977 | | | | | | | | | | | | | | | | | | | |
| 7AM | 1450 | 1650 | 1700 | 990 | 900 | 910 | 400 | 1550 | 1780 | 410 | 108 | | 16 | 16 | | | | | 2½ |
| 8 | 1440 | 1650 | 1690 | 1000 | 910 | 920 | 410 | 1420 | 1620 | 410 | 108 | | 16 | 16 | | | | | 2½ |
| 9 | 1620 | 1800 | 1890 | 1030 | 940 | 940 | 440 | 1970 | 1830 | 410 | 108 | | 16 | 16 | | | | | 2½ |
| 10 | 1550 | 1740 | 1810 | 1090 | 990 | 1010 | 440 | 1840 | 1870 | 430 | 112 | | 16 | 16 | | | | | 2½ |
| 11 | 1560 | 1740 | 1820 | 1090 | 990 | 1020 | 450 | 1820 | 1880 | 420 | 110 | | 16 | 16 | | | | | 2½ |
| 12 N | 1560 | 1760 | 1830 | 1100 | 1010 | 1040 | 460 | 1820 | 1880 | 430 | 110 | 5.5% | 16 | 16 | 34.0 | .0% | 22,800 | 4,920 | 2½ |
| 1 PM | 1510 | 1730 | 1770 | 1070 | 980 | 1030 | 450 | 1820 | 1770 | 450 | 112 | | 16 | 16 | | | | | 2½ |
| 2 | 1500 | 1710 | 1750 | 1050 | 960 | 980 | 450 | 1810 | 1800 | 360 | 106 | | 16 | 16 | | | | | 2½ |
| 3 | 1500 | 1700 | 1740 | 1010 | 940 | 970 | 440 | 1890 | 1830 | 400 | 112 | | 16 | 16 | | | | | 2½ |
| 4 | 1490 | 1710 | 1750 | 1015 | 935 | 970 | 440 | 1875 | 1845 | 370 | 106 | | 16 | 16 | | | | | 2½ |
| 5 | 1495 | 1690 | 1735 | 1005 | 925 | 965 | 435 | 1790 | 1795 | 390 | 108 | | 16 | 16 | | | | | 2½ |
| 6 | 1490 | 1685 | 1720 | 1005 | 930 | 955 | 455 | 1910 | 1800 | 395 | 108 | | 16 | 16 | | | | | 2½ |
| 7 | 1470 | 1695 | 1695 | 1025 | 945 | 945 | 435 | 1810 | 1755 | 395 | 110 | | 16 | 16 | | | | | 2½ |
| 8 | 1485 | 1715 | 1715 | 1025 | 945 | 945 | 435 | 1720 | 1785 | 395 | 108 | 11.4% | 16 | 16 | 33.4 | .4% | 26,640 | 6,240 | 2½ |
| 9 | 1505 | 1725 | 1735 | 1060 | 960 | 965 | 435 | 1625 | 1710 | 405 | 108 | | 16 | 16 | | | | | 2½ |
| 10 | 1535 | 1725 | 1750 | 1105 | 980 | 965 | 445 | 1920 | 1835 | 395 | 106 | | 16 | 16 | | | | | 2½ |
| 11 | 1540 | 1725 | 1700 | 1115 | 995 | 965 | 445 | 1975 | 1820 | 400 | 106 | | 16 | 16 | | | | | 2½ |
| 12 M | 1560 | 1730 | 1650 | 1180 | 1040 | 990 | 450 | 1840 | 1840 | 400 | 106 | | 16 | 16 | | | | | 2½ |
| May 9, 1977 | | | | | | | | | | | | | | | | | | | |
| 1 AM | 1600 | 1730 | 1730 | 1180 | 1030 | 1000 | 460 | 1870 | 1870 | 410 | 106 | | 16 | 16 | | | 23,520 | 5,570 | 2½ |
| 2 | 1620 | 1740 | 1750 | 1200 | 1070 | 1030 | 460 | 1880 | 1890 | 400 | 106 | | 16 | 16 | | | | | 2½ |
| 3 | 1600 | 1750 | 1770 | 1200 | 1100 | 1070 | 470 | 1890 | 1890 | 410 | 106 | | 16 | 16 | | | | | 2½ |
| 4 | 1580 | 1760 | 1840 | 1250 | 1130 | 1160 | 480 | 1930 | 1900 | 350 | 106 | 6.5% | 16 | 16 | | | | | 2½ |
| 5 | 1540 | 1760 | 1720 | 1170 | 1100 | 1190 | 470 | 1920 | 1820 | 380 | 106 | | 16 | 16 | | | | | 2½ |
| 6 | 1520 | 1760 | 1720 | 1110 | 1140 | 1150 | 460 | 1840 | 1700 | 360 | 104 | | 16 | 16 | | | | | 2½ |

From the foregoing, it can be seen that there has been provided by the applicant's new and novel process improvements an important step in the conversion of lignite in an existing furnace to a specification char by raising the furnace hearths to the approximate temperature ranges herein specified while utilizing the volatiles driven off the lignite for self-sustaining combustion in the hearth and while introducing sufficient combustion air to assure complete combustion of the process in at least the first hearth and in the stack. By utilizing the mechanical introduction of combustion air into the third hearth in the form of compressed air and by utilizing the hearth doors in the remaining hearths to admit ambient combustion air the specification char is obtained at the outlet to the furnace having the volatile contents hereinbefore specified. It should be apparent from a reading of the specification and a study of the drawing that many changes may be made in the new and novel process and the steps of the process within the spirit and scope of the invention and the invention is not to be limited to the exact process and steps and specifications herein described in the preferred embodiment which has been given by way of illustration only.

Having described my invention, I claim:

1. In a multi-hearth furnace for converting lignite to produce specification char having a controlled residual volatile content wherein sufficient quantities of combustion air and supplemental fuel are introduced into the furnace to raise the temperature of the furnace and a given quantity of lignite is introduced into the furnace and is successively passed from one hearth to the next adjacent hearth until the completed char is withdrawn from the last hearth, the improvement comprising:

(a) controlling the temperatures in the first hearth in range of between approximately 1450° to 1620° F while admitting sufficient combustion air to the first hearth to assure complete combustion of volatiles driven off within at least the first hearth and in the stack and to drive off a major portion of the moisture contained in the lignite;

(b) controlling the temperature in the second hearth in the range of between approximately 1650° and 1800° F while admitting sufficient combustion air to the second hearth to assure combustion of the volatiles driven off within the second hearth and to drive off the remainder of the moisture contained in the lignite and to drive off a portion of the volatiles contained in the lignite;

(c) controlling the temperature in the third hearth in the range of between approximately 1650° and 1890° F while admitting sufficient combustion air to the third hearth to assure combustion of the volatiles driven off within the third hearth and to drive off a major portion of the volatiles contained in the lignite, the volatiles driven off of the lignite in the second and third hearth being burned off in the furnace in all hearths by mixing with the previously admitted combustion air so that the furnace is self-sustaining after being initially ignited and heated up by the use of the supplemental fuel; and (d) controlling the temperature in at least one more hearth in the range of approximately 990° to 1250° F to control and drive off a predetermined portion of the volatiles in the lignite to thereby control the volatile content of the final specification char produced in the multi-hearth furnace.

2. The improvement as defined in claim 1 further comprising the step of:

(e) controlling the temperature in a further hearth in the range of approximately 900° to 1140° F to further control and drive off a predetermined portion of the volatiles in the lignite to thereby further control the volatile content of the specification char.

3. The improvement as defined in claim 2 further comprising the step of:

(f) controlling the temperature in the final hearth of the furnace in the range of approximately 910° to 1190° F to finally control and drive off a predetermined portion of the volatiles in the lignite to finalize the voltile content of the specification char.

4. A process for producing specification char, having a controlled residual volatile content, from lignite in a multi-hearth furnace having at least three hearths, comprising the steps of:

(a) introducing given quantities of lignite in the first and passing the introduced lignite to succeeding hearths while introducing sufficient quantities of combustion air and fuel into the furnace to ignite the fuel previously introduced and to raise the temperature of the furnace;

(b) raising the temperature in the first hearth in the range of approximately 1450° to 1620° F while raising the temperature in the second and third hearths in the range of approximately 1650° to 1800° F and 1650° to 1890° F respectively, the raising of the hearths to the beforementioned temperature being sufficient to drive off the moisture in the lignite and to drive off a major portion of the volatiles in the lignite so that the volatiles can burn in the hearths and make the process self-sustaining thereby permitting the combustion fuel to be shut off;

(c) continuing to supply sufficient quantities of combustion air to the furnace to assure complete combustion of the lignite volatiles in at least the first hearth and in the stack; and (d) controlling the temperatures in the first three hearths of the furnace to the ranges beforementioned and controlling the temperature in any further succeeding hearths in a range of approximately 900° to 1250° F in order to control the degree of volatile removal of the lignite in order to produce the specification char.

5. The process as defined in claim 4 wherein the volatile content of the char ranges between 5 and 12 percent.

6. The process as defined in claim 4 wherein the volatile content of the char ranges between 5.5 and 11.4 percent.

7. The improvement as defined in claim 1 wherein the volatile content of the char ranges between approximately 5 and 12 percent.

8. The improvement as defined in claim 1 wherein the volatile content of the char ranges between approximately 5.5 and 11.4 percent.

9. The process as defined in claim 4 wherein the volatile content of the char ranges between 1 and 20 percent.

10. The improvement as defined in claim 1 wherein the volatile content of the char ranges between approximately 1 and 20 percent.

* * * * *